US010215477B2

(12) United States Patent
Choo et al.

(10) Patent No.: US 10,215,477 B2
(45) Date of Patent: Feb. 26, 2019

(54) REFRIGERATOR

(71) Applicant: LG ELECTRONICS INC., Seoul (KR)

(72) Inventors: Ayoung Choo, Seoul (KR); Jaeyoul Lee, Seoul (KR); Youngmi Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 37 days.

(21) Appl. No.: 15/329,553

(22) PCT Filed: Jul. 6, 2015

(86) PCT No.: PCT/KR2015/006930
§ 371 (c)(1),
(2) Date: Jan. 26, 2017

(87) PCT Pub. No.: WO2016/017951
PCT Pub. Date: Feb. 4, 2016

(65) Prior Publication Data

US 2017/0248362 A1 Aug. 31, 2017

(30) Foreign Application Priority Data

Jul. 31, 2014 (KR) ..... 10-2014-0098311

(51) Int. Cl.
*F25D 23/02* (2006.01)
*F25D 23/04* (2006.01)
(Continued)

(52) U.S. Cl.
CPC ..... *F25D 23/126* (2013.01); *B67D 1/0004* (2013.01); *B67D 1/0081* (2013.01);
(Continued)

(58) Field of Classification Search
CPC ..... F25D 23/126; F25D 2323/122; F25C 2400/14
(Continued)

(56) References Cited

U.S. PATENT DOCUMENTS 2,276,937 A 3/1942 Cordova
2010/0287972 A1* 11/2010 Lee ..... F25C 1/25 62/347
(Continued)

FOREIGN PATENT DOCUMENTS

CN 101441019 A 5/2009
CN 102818423 A 12/2012
(Continued)

*Primary Examiner* — Jeremy Carroll
(74) *Attorney, Agent, or Firm* — Dentons US LLP

(57) ABSTRACT

Disclosed is a refrigerator and, more particularly, to a refrigerator including a water tank provided at a refrigerator door to store water therein. The refrigerator includes a cabinet having a storage compartment, a door provided at the cabinet, a water tank separably coupled to the door, an inlet port formed in the door to allow water, stored in the water tank, to be introduced into the door, a support structure provided at the door to support the bottom of the water tank, a fixing unit provided at the door to fix the water tank, and a handle provided at the water tank to enable separation of the water tank from the fixing unit.

17 Claims, 7 Drawing Sheets

(51) Int. Cl.

| | |
|---|---|
| ***F25D 23/12*** | (2006.01) |
| ***B67D 1/00*** | (2006.01) |
| ***B67D 1/08*** | (2006.01) |
| ***F25D 11/00*** | (2006.01) |

(52) U.S. Cl.
CPC ..... *B67D 1/0891* (2013.01); *F25D 11/00* (2013.01); *F25D 23/028* (2013.01); *F25D 23/04* (2013.01); *B67D 2210/00036* (2013.01); *F25D 2323/122* (2013.01)

(58) Field of Classification Search
USPC ..... 222/181.3, 325
See application file for complete search history.

(56) References Cited

U.S. PATENT DOCUMENTS

2011/0067433 A1* 3/2011 An ..... F25D 23/126 62/465
2013/0133352 A1* 5/2013 Park ..... F25D 23/12 62/318
2013/0133354 A1* 5/2013 Park ..... F25C 1/00 62/340
2013/0133355 A1* 5/2013 Park ..... F25D 23/12 62/340
2013/0146179 A1* 6/2013 McMahan ..... B67D 7/221 141/83

FOREIGN PATENT DOCUMENTS

| | | | |
|---|---|---|---|
| CN | 103115474 | A | 5/2013 |
| CN | 103134261 | A | 6/2013 |
| CN | 103604260 | A | 2/2014 |
| EP | 2 428 755 | A2 | 3/2012 |
| EP | 2 600 084 | A2 | 6/2013 |
| JP | S48-18624 | Y1 | 5/1973 |
| JP | 2012-32030 | A | 2/2012 |
| KR | 10-0430217 | B1 | 5/2004 |
| KR | 10-0547432 | B1 | 1/2006 |
| KR | 10-2010-0053978 | A | 5/2010 |
| KR | 10-2013-0059988 | A | 6/2013 |
| KR | 10-2014-0075300 | A | 6/2014 |
| KR | 10-2014-0075302 | A | 6/2014 |

* cited by examiner

[Fig. 1]
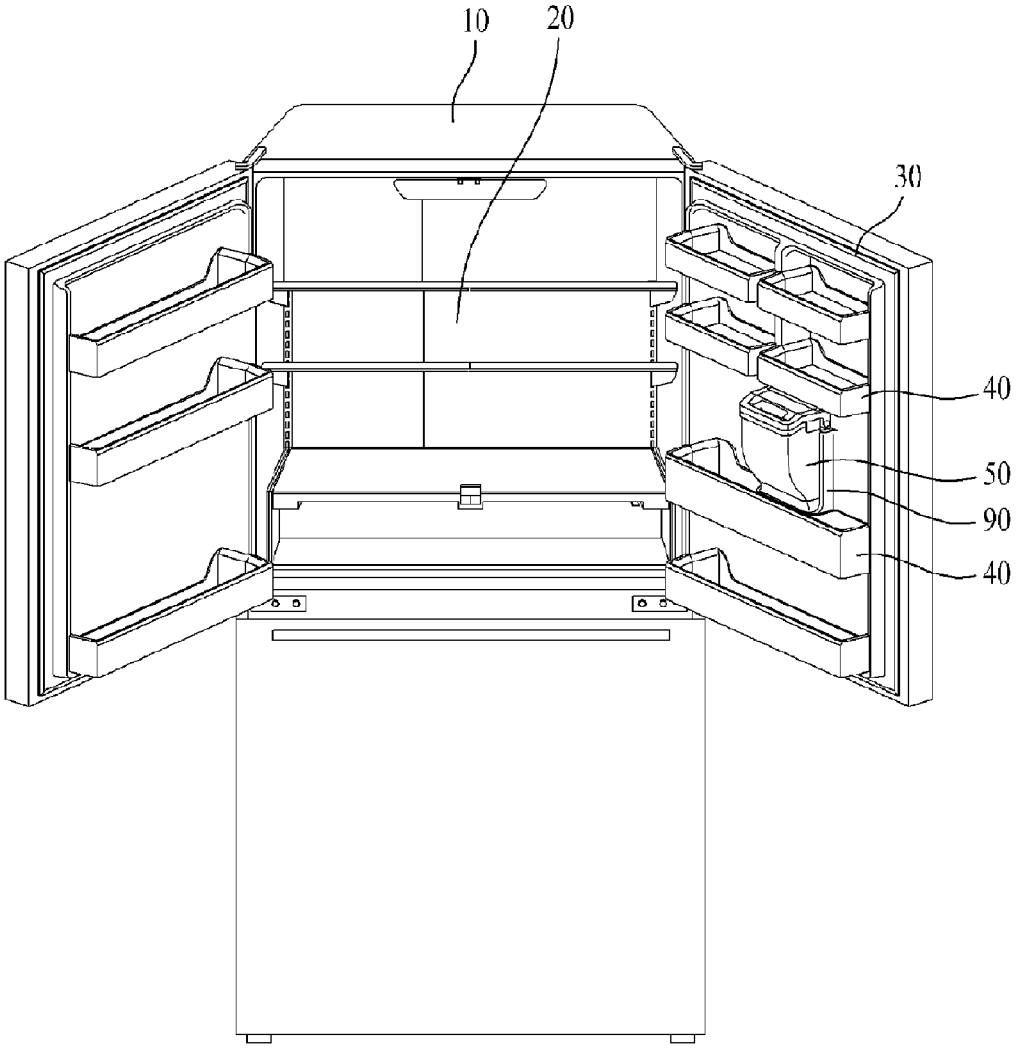

[Fig. 2]
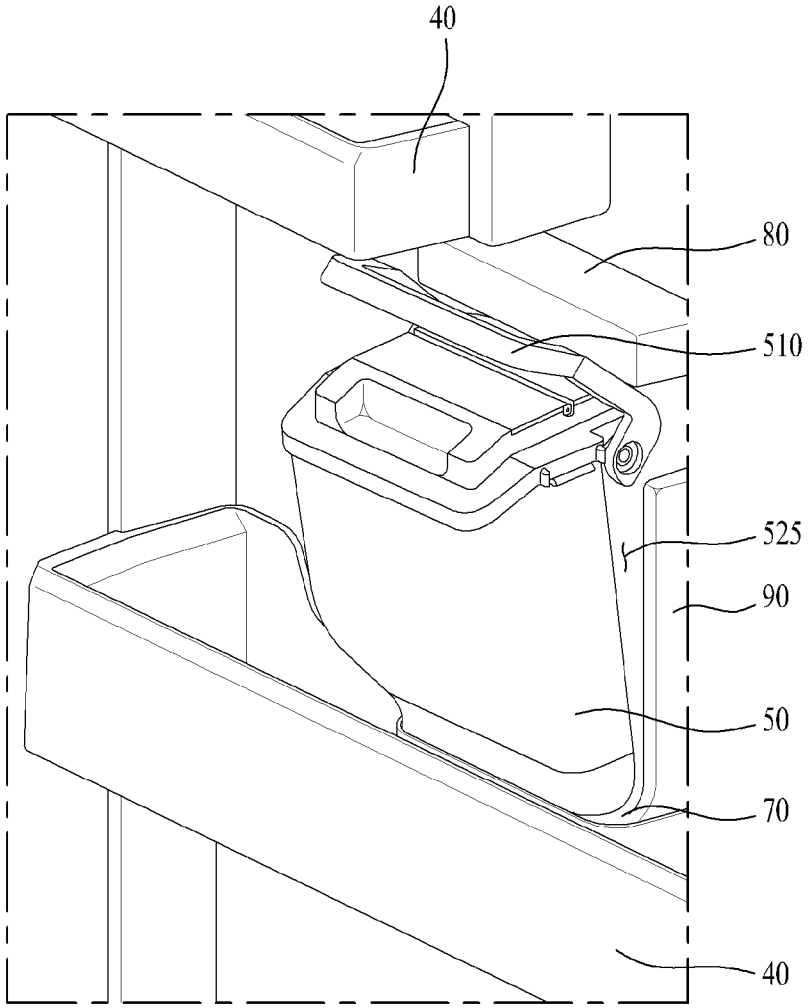

[Fig. 3]
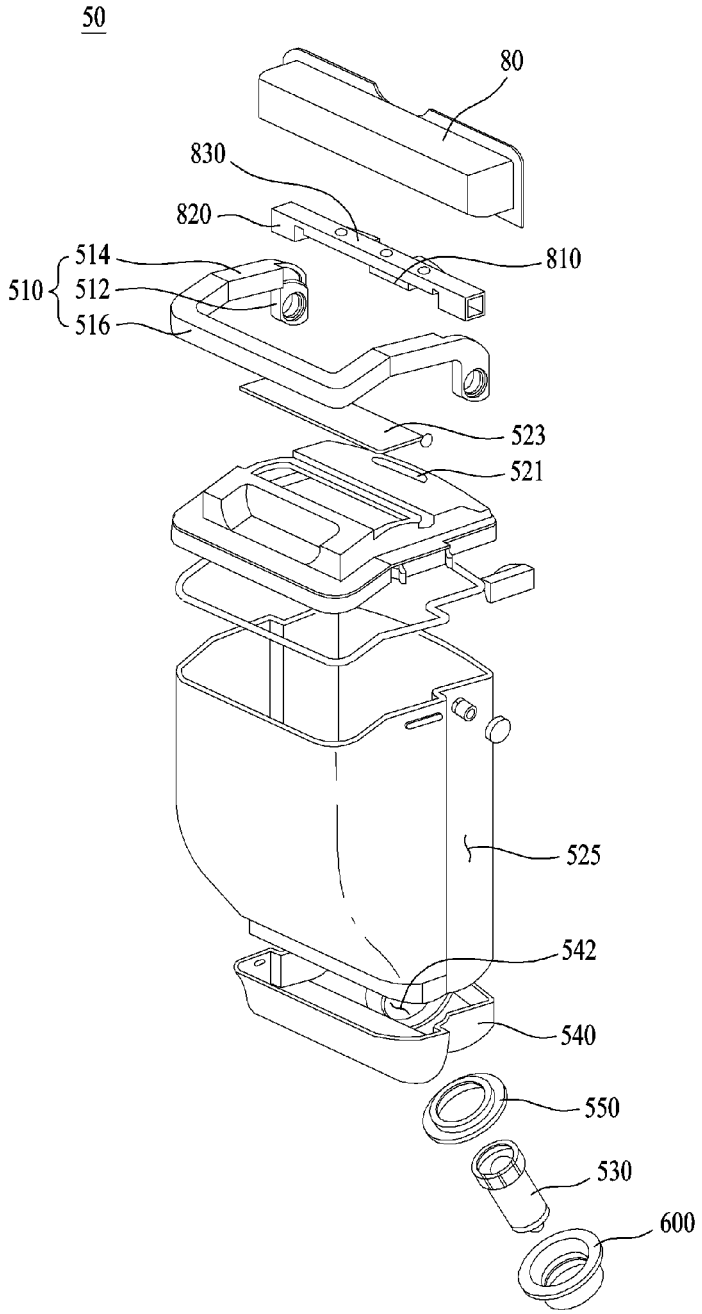

[Fig. 4]
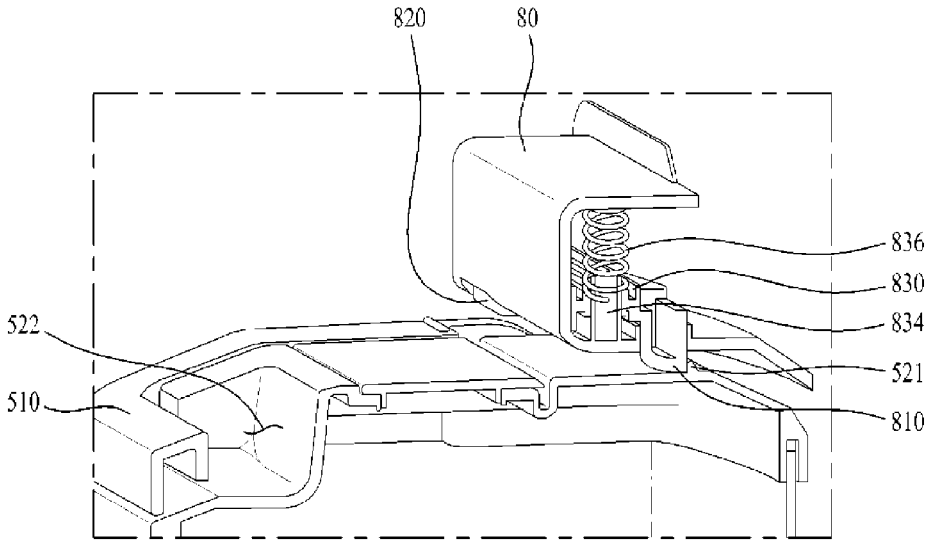
(a)
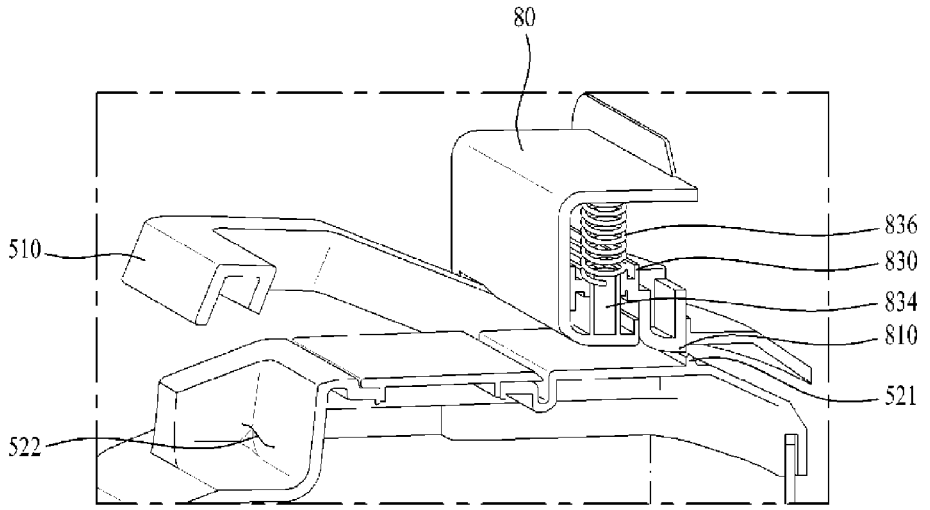
(b)

[Fig. 5]
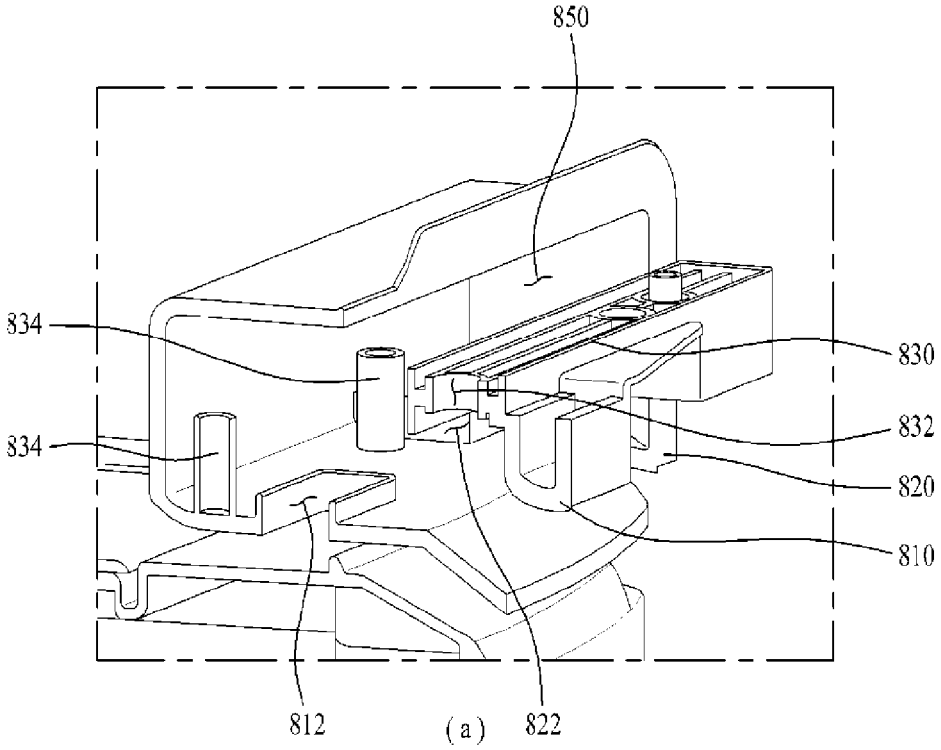
(a)
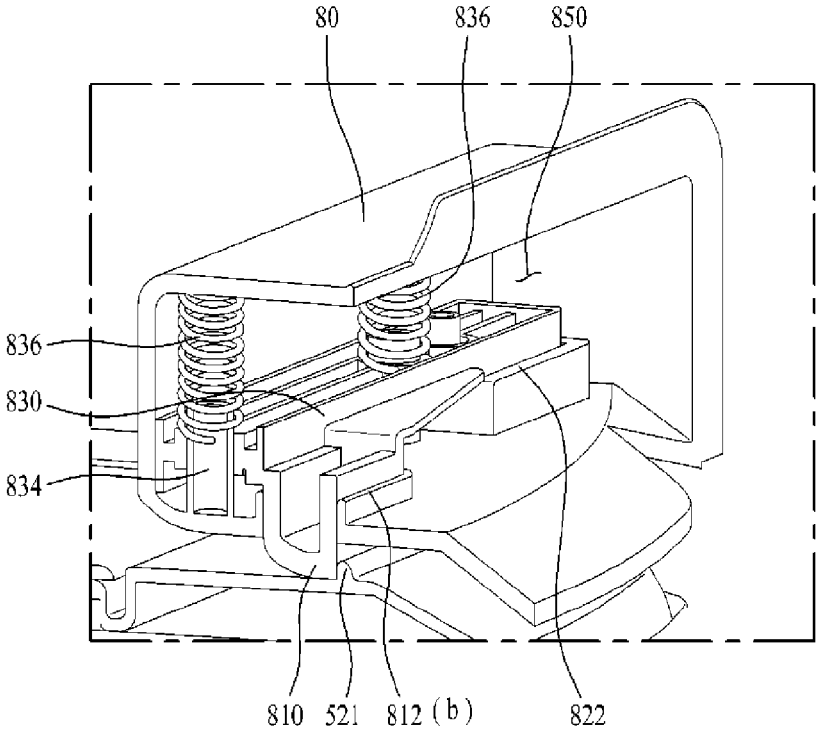
(b)

[Fig. 6]
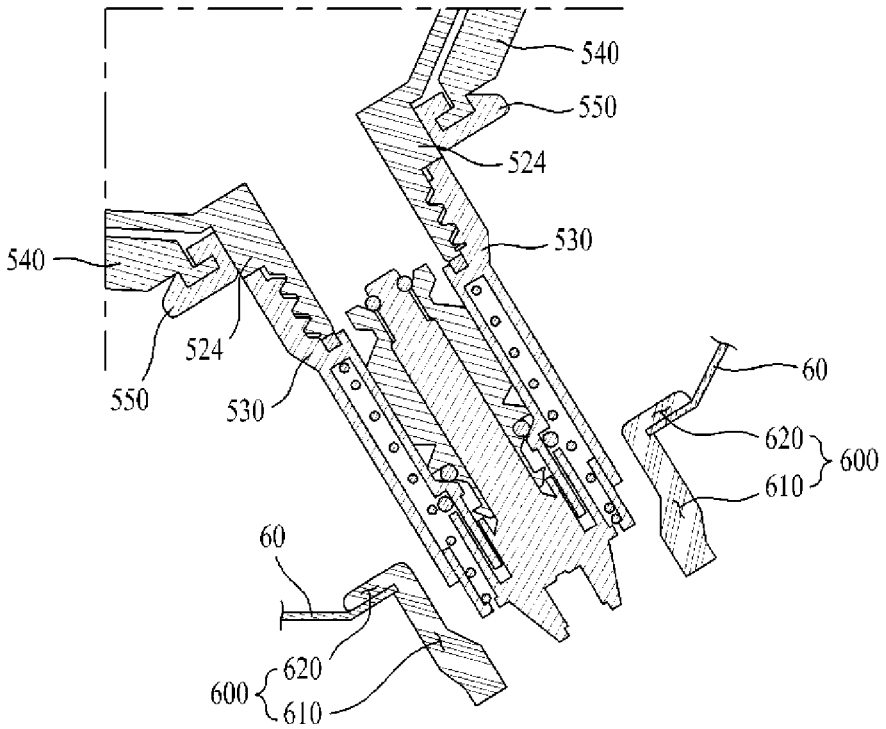
(a)
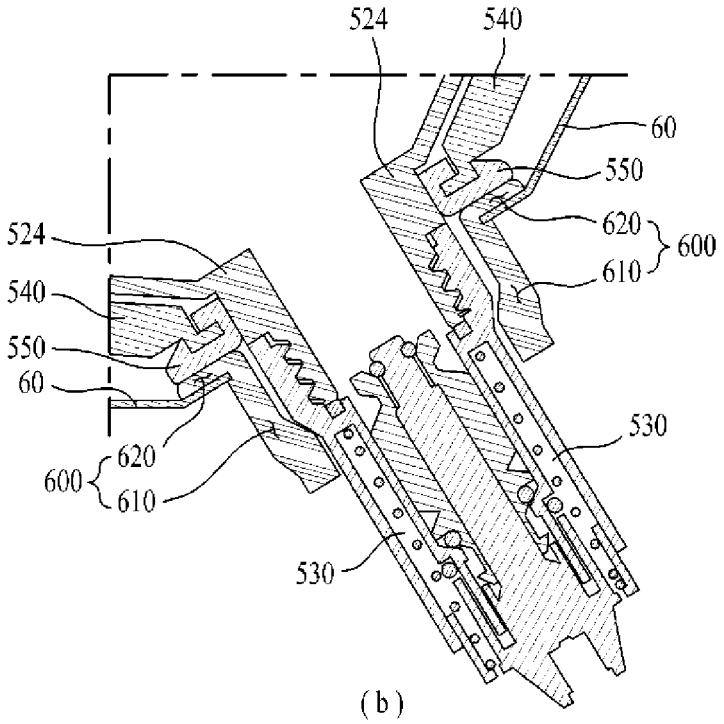
(b)

[Fig. 7]
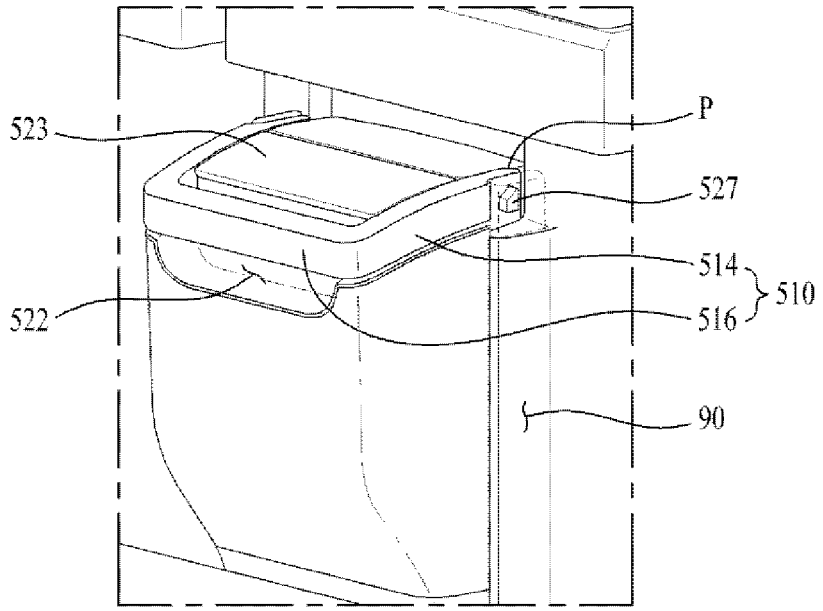
(a)
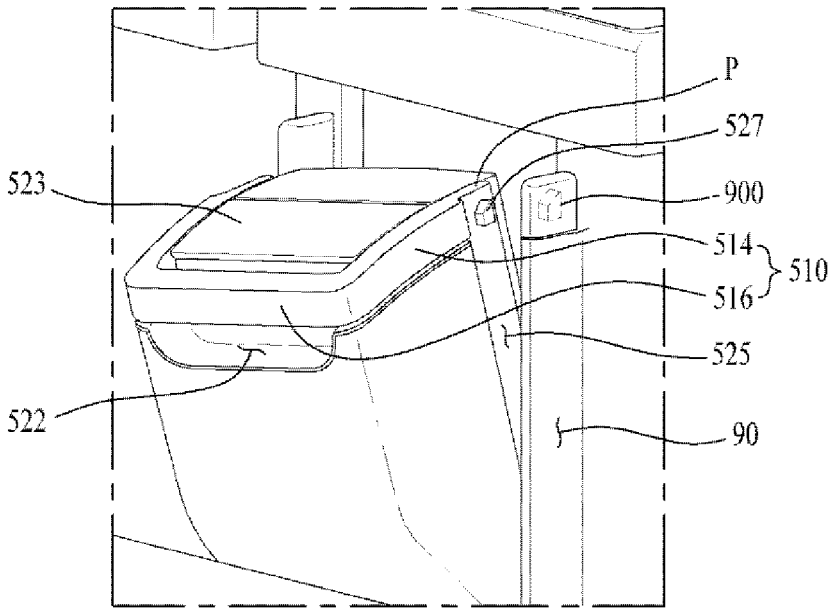
(b)

REFRIGERATOR

This application is a National Stage Application of International Application No. PCT/KR2015/006930 filed on Jul. 6, 2015, which claims the benefit of Korean Patent Application No. 10-2014-0098311 filed on Jul. 31, 2014, all of which are hereby incorporated by reference in their entirety for all purposes as if fully set forth herein.

TECHNICAL FIELD

The present invention relates to a refrigerator and, more particularly, to a refrigerator including a water tank provided at a refrigerator door to store water therein.

BACKGROUND ART

A refrigerator refers to an apparatus that includes a storage compartment therein to store items such as, for example, food and serves to generate cold air using a refrigeration cycle and to supply the cold air to the storage compartment so as to keep the stored items at a low temperature for a long term.

The refrigerator uses the refrigeration cycle to generate the cold air to be supplied to the storage compartment. The refrigeration cycle consists of a compression process, a condensation process, an expansion process, and an evaporation process, and refrigerant from the evaporation process is again routed back to the compression process.

Considering the refrigeration cycle in detail, the compression process is a process in which high temperature and low pressure gas-phase refrigerant is changed into high temperature and high pressure gas-phase refrigerant by a compressor, the condensation process is a process in which the high temperature and high pressure gas-phase refrigerant is changed into middle temperature and high pressure liquid-phase refrigerant by a condenser, the expansion process is a process in which the middle temperature and high pressure liquid-phase refrigerant is changed into low temperature and low pressure liquid-phase refrigerant by an expansion valve, and the evaporation process is a process in which the low temperature and low pressure liquid-phase refrigerant is changed into high temperature and low pressure gas-phase refrigerant by an evaporator.

Accordingly, in the evaporation process of the refrigeration cycle, the refrigerant absorbs external heat, causing the surrounding air to be cooled and kept at a low temperature. The resulting cold air is supplied to the storage compartment.

The refrigerator generally includes a freezing compartment, the temperature of which is set to lower than zero degrees in order to keep stored items frozen, and a refrigerating compartment, the temperature of which is set to be lower than room temperature in order to keep stored items fresh.

In general, drinking water, beverages and the like are stored in the refrigerating compartment. When it is required to open the refrigerator door whenever a user retrieves drinking water stored in the refrigerating compartment, this causes frequent discharge of cold air from the storage compartment, resulting in wasted energy.

To solve this problem, in the related art, a water tank is provided at the rear surface of the door to penetrate the door so as to allow the user to drink the water stored in the water tank.

However, the related art has problems in that separating or coupling the water tank from or to the rear surface of the door is difficult because of the weight of water stored in the water tank and in that cold air inside the storage compartment may leak outward through a water tank penetration region in the door formed from the inside to the outside.

DISCLOSURE OF INVENTION

Technical Problem

Therefore, the present invention has been made in view of the above problems, and it is one object of the present invention to provide a refrigerator including a water tank which enables a user to easily separate or couple the water tank from or to a door.

In addition, it is another object of the present invention to provide a refrigerator which is capable of preventing cold air inside a storage compartment from leaking outward through a door in the state in which a water tank is fixed to the door.

Solution to Problem

In accordance with one aspect of the present invention, the above and other objects can be accomplished by the provision of a refrigerator including a cabinet having a storage compartment, a door provided at the cabinet, a water tank separably coupled to the door, an inlet port formed in the door to allow water, stored in the water tank, to be introduced into the door, a support structure provided at the door to support the bottom of the water tank, a fixing unit provided at the door to fix the water tank, and a handle provided at the water tank to enable separation of the water tank from the fixing unit.

The handle may be pivotally rotatably provided at the water tank, and the water tank may be separated from the fixing unit when the handle is rotated.

The fixing unit may include a first protrusion configured to be moved by elastic force, and the water tank may be separably coupled to the first protrusion.

The refrigerator may further include a fixing rib configured to protrude from the top of the water tank so as to be separably coupled to the first protrusion.

The handle may be configured to move the first protrusion upward and downward.

The handle may include a first member pivotally rotatably connected to a side surface of the water tank, the first member extending upward of the water tank, a second member connected to the first member, the second member extending forward of the water tank, and a third member connected to the second member, the third member extending in a direction parallel to a front surface of the water tank.

The first member may be shorter than the second member.

The second member may be configured to vertically move the first protrusion.

The refrigerator may further include a first recess formed in the top of the water tank by cutting.

The refrigerator may further include an outlet port provided at the bottom of the water tank, a valve assembly provided at an outer circumferential surface of the outlet port to selectively open or close the outlet port, a decorative member having a first through-hole for penetration of the outlet port, the decorative member being provided at the bottom of the water tank, and a sealing member coupled to an inner circumferential surface of the first through-hole.

The refrigerator may further include cap provided at the inlet port, and the cap may include an insertion portion for insertion of the valve assembly and an extension perpendicularly extending from the insertion portion.

The extension may come into surface contact with the sealing member.

The fixing unit may include a second protrusion connected to the first protrusion so as to protrude toward the water tank, and the second protrusion may be configured to be moved upward and downward by the handle.

The fixing unit may include a connector configured to connect the first protrusion and the second protrusion to each other, a second through-hole perforated through the connector, and a guide member provided at the door to guide the second through-hole.

The connector may be moved upward and downward by the guide member.

The refrigerator may further include a pivotally rotatable cover provided at the top of the water tank.

The refrigerator may further include a rib provided in a height direction of the water tank to support a side surface of the water tank.

The refrigerator may further include a seating portion recessed in the side surface of the water tank by bending.

The fixing unit may include a third protrusion provided at the seating portion and a second recess formed in the rib, and the third protrusion may be separably coupled to the second recess.

The handle may include a fourth protrusion, and the fourth protrusion may be configured to come into contact with a rear surface of the door when the handle is raised.

Advantageous Effects of Invention

The present invention has the effect of providing a refrigerator including a water tank which enables a user to easily separate or couple the water tank from or to a door.

In addition, the present invention has the effect of providing a refrigerator which is capable of preventing cold air inside a storage compartment from leaking outward through a door in the state in which a water tank is fixed to the door.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view illustrating a refrigerator including a water tank installed to a door according to one embodiment of the present invention;

FIG. 2 is a perspective view illustrating separation of the water tank from the door of the refrigerator according to one embodiment of the present invention;

FIG. 3 is an exploded perspective view illustrating the water tank according to one embodiment of the present invention;

FIG. 4(*a*) is a perspective view illustrating the top of the water tank fixed to the door according to one embodiment of the present invention;

FIG. 4(*b*) is a perspective view illustrating the top of the water tank separated from the door according to one embodiment of the present invention;

FIGS. 5(*a*) and 5(*b*) are perspective views illustrating the assembly process of a fixing unit according to one embodiment of the present invention;

FIG. 6(*a*) is a sectional view illustrating the bottom of the water tank immediately before the water tank is inserted into the door according to one embodiment of the present invention;

FIG. 6(*b*) is a sectional view illustrating the bottom of the water tank after the water tank is inserted into the door according to one embodiment of the present invention;

FIG. 7(*a*) is a perspective view illustrating the water tank fixed to the door according to another embodiment of the present invention; and FIG. 7(*b*) is a perspective view illustrating the water tank separated from the door according to another embodiment of the present invention.

BEST MODE FOR CARRYING OUT THE INVENTION

Hereinafter, exemplary embodiments of the present invention will be described in detail with reference to the accompanying drawings. Meanwhile, a configuration or a control method of an apparatus that will be described hereinafter is provided for explanation of the embodiments of the present invention, and is not intended to limit a technical range of the present invention. The same reference numerals of the entire specification designate the same constituent elements.

As exemplarily illustrated in FIG. 1, a refrigerator according to one embodiment of the present invention, which includes a water tank 50 provided at a door 30, will be described below.

The refrigerator according to one embodiment of the present invention may include a cabinet 10 having a storage compartment 20 therein, the door 30 coupled to the cabinet 10, and the water tank 50 installed to the door 30.

The cabinet 10 defines the external appearance of the refrigerator, and the door 30 may be pivotally rotatably coupled to one side of the cabinet 10 using hinges. In addition, the door 30 may be provided at the rear surface thereof with door baskets 40.

The water tank 50 may be separably coupled to the rear surface of the door 30 and located between the door baskets 40.

In addition, the water tank 50 may store water therein and the temperature of the water is lowered by cold air supplied into the storage compartment 20.

The water tank 50 penetrates the door 30 so as to communicate with the outside. As such, a user can drink the water stored in the water tank 50 without opening the door 30. That is, the user can retrieve the water stored in the water tank using a dispenser provided at the front surface of the door 30.

Accordingly, since there is no need to unnecessarily open the door 30, the temperature inside the storage compartment 20 may be maintained and power required to supplement cold air that escapes when the door 30 is opened may be reduced.

As exemplarily illustrated in FIG. 2, the refrigerator according to one embodiment of the present invention may include a support structure 70 to support the bottom of the water tank 50, a fixing unit 80 to fix the water tank 50, and a handle 510 to separate the water tank 50 from the fixing unit 80.

Generally, in order to fix the water tank 50 to the door 30, there is provided a single member that serves to support and fix the water tank 50.

However, for the water tank 50 included in the refrigerator according to one embodiment of the present invention, the support structure 70 is provided to support the weight of the water tank 50 and the fixing unit 80 is provided to fix the water tank 50 to the door 30 to prevent unintentional separation of the water tank 50. Accordingly, when the water tank 50 is released from the fixing unit 80 using the handle 510, the water tank 50 is separated from the door 30.

The support structure 70 may protrude from the rear surface of the door 30 to support the bottom of the water tank 50. In addition, the support structure 70 may be recessed to surround a lower portion of the water tank 50.

Unlike the support structure 70 described just above, the support structure 70 may include a stepped recessed portion (not illustrated) of the door 30 to enable the insertion of a body of the water tank 50 and a support surface (not illustrated) provided at the lower end of the recessed portion to support the lower surface of the water tank 50.

Meanwhile, the door 30 may be provided at the rear surface thereof with an inlet port 60 (see FIG. 6) to allow the water stored in the water tank 50 to be introduced to the door 30.

The inlet port 60 may be formed inside the support structure 70. This is because the support structure 70 comes into contact with the lower surface of the water tank 50 and a valve assembly 530 (see FIG. 6) that will be described below is provided at the bottom of the water tank 50 so as to be inserted into the inlet port 60.

FIG. 3 is an exploded perspective view illustrating the water tank and the fixing unit included in the refrigerator according to one embodiment of the present invention.

Hereinafter, the handle 510 included in the refrigerator according to one embodiment of the present invention will be described with reference to FIG. 3.

The handle 510 is pivotally rotatably provided at the water tank 50. As such, the water tank 50 is separated from the fixing unit 80 when the handle 50 is rotated upward.

In addition, the handle 510 may be located at the top of the water tank 50 to allow the user to conveniently move the water tank 50 separated from the door 30.

The handle 510 may include a first member 512 connected to the water tank 50 and a second member 514 connected to the first member 512.

One side of the first member 512 may be pivotally rotatably hinged to the side surface of the water tank 50 and the other side of the first member 512 may extend upward of the water tank 50.

In addition, one side of the second member 514 may be connected to the first member 512 and the other side of the second member 514 may extend forward of the water tank 50. Alternatively, the second member 514 may extend horizontally from the side surface of the water tank 50.

In other words, the handle 510 may include the first member 512 that faces upward and is rotatably connected to the side surface of the water tank 50 and the second member 514 connected to the first member 512 to obliquely extend upward and forward of the water tank 50 by a prescribed angle. In addition, the prescribed angle may be approximately 90 degrees.

The second member 514 is pivotally rotated upward and downward by the same angle as that of the first member 512 when the first member 512 is pivotally rotated upward and downward. The second member 514 may serve to release the fixing unit 80 (see FIG. 4) that will be described below.

Although the fixing unit 80 may be released using only the second member 514, additionally providing the first member 512 may reduce the rotation angle of the handle 510 required to reach the fixing unit 80 compared to the case in which only the second member 514 is provided. Accordingly, the convenience of the user who has to raise the second member 514 at the front side of the water tank 50 may be increased.

In addition, the first member 512 may be shorter than the second member 514. This is because the first member 512 would be limited in rotation by the rear surface of the door 30 when it were longer than the second member 514.

Meanwhile, two first members 512 and two second members 514 may be provided respective at both side surfaces of the water tank 50 and a third member 516 may be provided to interconnect the second members 514 provided at left and right sides thereof.

The third member 516 is horizontally provided at the front surface of the water tank 50 and horizontally extends from the second members 514. As such, the user can grip and pivotally rotate the third member 516 upward and downward at the front surface of the water tank 50, which increases user convenience.

A first recess 522 may be indented in the upper surface of the water tank 50 by cutting. The first recess 522 may be located at the front side (see FIG. 4) or the rear side (see FIG. 7) of the third member 516.

In this way, the user can easily grip the third member 516 using the first recess 522 as needed.

Now, the fixing unit 80 of the refrigerator according to one embodiment of the present invention will be described with reference to FIGS. 4(*a*) and 4(*b*).

The fixing unit 80 may be provided at the rear surface of the door 30 to fix the water tank 50.

In addition, the fixing unit 80 may include a first protrusion 810 to fix the water tank 50.

In addition, the first protrusion 810 is configured to be movable using elastic force and may be movable upward and downward.

To this end, the fixing unit 80 may include an elastic member 836 to apply elastic force to the first protrusion 810. The elastic member 836 may be a spring.

The first protrusion 810 is configured to receive push force from the elastic member 836. Thus, the first protrusion 810 is not stationary and is movable by the elastic member 836.

The water tank 50 may include a fixing rib 521 provided at the top thereof so as to be fixed by the first protrusion 810.

The fixing rib 521 may protrude from the upper surface of the water tank 50 and have a prescribed length in the direction parallel to the front surface of the water tank 50.

Although not illustrated in the drawings, in another embodiment, the fixing rib may be replaced with an indentation formed in the upper surface of the water tank 50 such that the first protrusion 810 is inserted into the indentation to fix the water tank 50.

In addition, although the first protrusion 810 is adapted to fix the fixing rib 521 using the push force of the elastic member 836, the first protrusion 810 cannot fix the fixing rib 521 when the elastic member 836 is compressed, and the water tank 50 is separated from the door 30.

Considering the shape of an end of the first protrusion 810, although the end of the first protrusion 810 is concavely curved to ensure easy introduction of the fixing rib 521, the first protrusion 810 also has an edge to fix the fixing rib 521 without a risk of unintentional separation of the fixing rib 521.

In addition, the fixing unit 80 may include a second protrusion 820 (see FIG. 3) connected to the first protrusion 810 so as to protrude from the first protrusion 810.

The second protrusion 820 is connected to the first protrusion 810 and, therefore, is movable by the elastic member 836 provided at the first protrusion 810.

In addition, the second protrusion 820 may be moved upward and downward by coming into contact with the second member 514 when the handle 510 is raised.

In one embodiment of the present invention, the fixing unit 80 may include a connector 830 to connect the first protrusion 810 and the second protrusion 820 to each other.

As exemplarily illustrated in FIGS. 5(*a*) and 5(*b*), the first protrusion 810 and the second protrusion 820 are moved together by the connector 830.

As such, when the second protrusion 820 comes into contact with the second member 514 to thereby be moved upward and downward, the first protrusion 810 may be moved upward and downward.

When the first protrusion 810 is moved upward, the fixing rib 521 is no longer fixed by the first protrusion 810. Accordingly, the water tank 50 is separated from the door 30.

Meanwhile, the connector 830 may have a first through-hole 832 perforated therein. The door 30 may include a guide member 834 to guide the first through-hole 832.

In addition, the fixing unit 80 may be provided at the rear surface of the door 30 such that a receiving space 850 is defined inside the fixing unit 80.

The guide member 834 may be located in the receiving space 850 inside the fixing unit 80 and configured to vertically protrude upward from the bottom of the receiving space 850.

The guide member 834 is configured to be inserted into the first through-hole 832 and serves to enable the vertical movement of the connector 830.

In this way, the guide member 834 serves to guide the connector 830, which has been moved upward by the handle 510, so as to return to an original position thereof by the elastic member 836.

Now, a structure between the water tank 50 and the inlet port 60 of the door 30 included in the refrigerator according to one embodiment of the present invention will be described.

As exemplarily illustrated in FIGS. 6(*a*) and 6(*b*), the water tank 50 may include an outlet port 524 formed therein and a valve assembly 530 to open or close the outlet port 524.

The outlet port 524 may be formed in the bottom of the water tank 50 in order to enable discharge of the water stored in the water tank 50 by gravity.

In addition, the outlet port 524 may protrude from the lower surface of the water tank 50.

In addition, the valve assembly 530 may be provided at the outer circumferential surface of the outlet port 524. The valve assembly 530 is a commercial member and, thus, a detailed description thereof will be omitted.

Meanwhile, the door 30 may have the inlet port 60 for insertion of the valve assembly 530.

Since the inlet port 60 is perforated through the door 30 so as to communicate with the outside, the inlet port 60 may cause the leakage of cold air from the storage compartment 20. A configuration to prevent this leakage of cold air will be described below.

In one embodiment of the present invention, the water tank 50 may include a decorative member 540 provided at the bottom thereof. The decorative member 540 may have a second through-hole 542 (see FIG. 3) for the penetration of the outlet port 524.

The decorative member 540 serves to prevent the bottom of the water tank 50 from being broken upon the separation or coupling of the water tank 50 and to fix a sealing member 550 that will be described below.

The water tank 50 may include the sealing member 550 coupled to the inner circumferential surface of the second through-hole 542 formed in the decorative member 540.

The outlet port 524 is configured to pass through the second through-hole 542 coupled with the sealing member 550. The inner diameter of the sealing member 550 is equal to the outer diameter of the outlet port 524.

As such, it is possible to prevent generation of a gap between the sealing member 550 and the outlet port 524 and, consequently, to prevent the leakage of cold air from the storage compartment 20 through the gap.

In addition, the sealing member 550 may be formed of a rubber material and may more efficiently prevent the leakage of cold air from the storage compartment 20.

Meanwhile, the refrigerator according to one embodiment of the present invention may include a cap 600 installed to the inlet port 60 into which the valve assembly 530 is inserted.

The cap 600 may include an insertion portion 610 into which the valve assembly 530 is inserted and an extension 620 extending perpendicular to the insertion portion 610.

The inner diameter of the insertion portion 610 is greater than the outer diameter of the valve assembly 530. As such, the user can easily insert the valve assembly 530 into the insertion portion 610.

The inner diameter of the insertion portion 610 may be gradually reduced as it becomes deeper. In addition, when the valve assembly 530 is completely inserted, any inner position of the insertion portion 610 may have the same diameter as the outer diameter of the valve assembly 530.

Accordingly, the valve assembly 530 may be fixed by the insertion portion 610 and may prevent the leakage of cold air from the storage compartment 20.

The extension 620 may be configured to come into surface contact with the sealing member 550. That is, the extension 620 may come into surface contact with the sealing member 550 of the water tank 50 inserted into the inlet port 60, thereby preventing the leakage of cold air from the storage compartment 20.

In addition, the cap 600 may be formed of a plastic material. This may prevent damage to the water tank 50 during the separation or coupling of the water tank 50.

The water tank 50, included in the refrigerator according to one embodiment of the present invention, may include a cover 523 pivotally rotatably connected to the top of the water tank 50 using hinges (not illustrated) (see FIG. 3).

As such, even in a state in which the water tank 50 is mounted to the door 30, water may be supplied to the water tank 50 as the cover 523 is opened.

The water tank 50 included in the refrigerator according to another embodiment of the present invention will be described below.

As exemplarily illustrated in FIGS. 7(*a*) and 7(*b*), ribs 90 (see FIG. 2) may be provided to support both side surfaces of the water tank 50.

The ribs 90 extend in the height direction of the water tank 50 and are provided respectively at both side surfaces of the water tank 50 to support the water tank 50.

Each side surface of the water tank 50 may be formed with a recessed seating portion 525 by bending (see FIG. 2).

The seating portion 525 may be recessed to have a shape that complements that of the rib 90 for coupling with the rib 90.

As compared with the previously described embodiment of the present invention, the present embodiment has differences in terms of the fixing unit 80 and the handle 510 and, thus, only the differences will be described below.

The fixing unit 80 may include a third protrusion 527 protruding from the side surface of the water tank 50 and a second recess 900 formed in the rib 90.

The second recess 900 may have a shape that complements that of the third protrusion 527.

In addition, the third protrusion 527 is separably coupled to the second recess 900. The handle 510 is movable upward and downward. When the handle 510 is rotated upward, the water tank 50 may be separated from the fixing unit 80.

Although the handle 510 may include the first members 512, the second members 514, and the third member 516 as in the previously described embodiment of the present invention, in the present embodiment, the handle 510 may include the second members 514 pivotally rotatably connected to the side surfaces of the water tank 50, and the third member 516 interconnecting the second members 514 provided at the left and right sides of the water tank 50.

The handle 510 may include a fourth protrusion (not illustrated) formed at a portion P of the second member 514 connected to the water tank 50.

As such, when the handle 510 is raised, the fourth protrusion (not illustrated) comes into contact with the rear surface of the door 30. When the handle 510 is raised beyond a given angle, the fourth protrusion (not illustrated) pushes the door 30, thus causing the third protrusion 527 to be separated from the second recess 900 by the push force.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a laundry treatment apparatus.

The invention claimed is:

1. A refrigerator comprising:
- a cabinet having a storage compartment;
- a door provided at the cabinet;
- a water tank separably coupled to the door;
- an inlet port formed in the door to allow water, stored in the water tank, to be introduced into the door;
- a support structure provided at the door to support the bottom of the water tank;
- a fixing unit provided at the door to fix the water tank, the fixing unit including a first protrusion configured to be moved by elastic force and separably coupled to the water tank; and
- a handle provided at the water tank to enable separation of the water tank from the fixing unit, the handle rotatably provided at the water tank,
- wherein the water tank is separated from the fixing unit when the handle is rotated.

2. The refrigerator according to claim 1, further comprising a fixing rib configured to protrude from the top of the water tank so as to be separably coupled to the first protrusion.

3. The refrigerator according to claim 2, wherein the handle is configured to move the first protrusion upward and downward.

4. The refrigerator according to claim 3, wherein the handle includes:
- a first member pivotally connected to a side surface of the water tank, the first member extending upward of the water tank;
- a second member connected to the first member, the second member extending forward of the water tank; and
- a third member connected to the second member, the third member extending in a direction parallel to a front surface of the water tank.

5. The refrigerator according to claim 4, wherein the first member is shorter than the second member.

6. The refrigerator according to claim 5, wherein the second member is configured to vertically move the first protrusion.

7. The refrigerator according to claim 3, further comprising a first recess formed in the top of the water tank by cutting.

8. The refrigerator according to claim 3, wherein the fixing unit includes a second protrusion connected to the first protrusion so as to protrude toward the water tank, and the second protrusion is configured to be moved upward and downward by the handle.

9. The refrigerator according to claim 8, wherein the fixing unit includes:
- a connector configured to connect the first protrusion and the second protrusion to each other;
- a first through-hole perforated through the connector; and
- a guide member provided at the door to guide the first through-hole.

10. The refrigerator apparatus according to claim 9, wherein the connector is moved upward and downward by the guide member.

11. The refrigerator according to claim 1, further comprising:
- an outlet port provided at the bottom of the water tank;
- a valve assembly provided at an outer circumferential surface of the outlet port to selectively open or close the outlet port;
- a decorative member having a second through-hole for penetration of the outlet port, the decorative member being provided at the bottom of the water tank; and
- a sealing member coupled to an inner circumferential surface of the second through-hole.

12. The refrigerator according to claim 11, further comprising cap provided at the inlet port,
- wherein the cap includes:
- an insertion portion for insertion of the valve assembly; and
- an extension perpendicularly extending from the insertion portion.

13. The refrigerator according to claim 12, wherein the extension comes into surface contact with the sealing member.

14. The refrigerator according to claim 1, further comprising a pivotally rotatable cover provided at the top of the water tank.

15. The refrigerator according to claim 1, further comprising a rib provided in a height direction of the water tank to support a side surface of the water tank.

16. The refrigerator according to claim 15, further comprising a seating portion recessed in the side surface of the water tank by bending.

17. The refrigerator according to claim 16, wherein the fixing unit includes:
- a third protrusion provided at the seating portion; and
- a second recess formed in the rib,
- wherein the third protrusion is separably coupled to the second recess.

* * * * *